US011078448B2

(12) United States Patent
Kim et al.

(10) Patent No.: US 11,078,448 B2
(45) Date of Patent: Aug. 3, 2021

(54) DETERGENT COMPOSITION CONTAINING A FLUORINATED SOLVENT FOR DRY CLEANING

(71) Applicant: LG ELECTRONICS INC., Seoul (KR)

(72) Inventors: Minji Kim, Seoul (KR); Jongseok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 96 days.

(21) Appl. No.: 16/476,617

(22) PCT Filed: Jan. 9, 2018

(86) PCT No.: PCT/KR2018/000384
§ 371 (c)(1),
(2) Date: Jul. 9, 2019

(87) PCT Pub. No.: WO2018/128514
PCT Pub. Date: Jul. 12, 2018

(65) Prior Publication Data

US 2019/0345417 A1 Nov. 14, 2019

(30) Foreign Application Priority Data

Jan. 9, 2017 (KR) ..... 10-2017-0003000

(51) Int. Cl.

| | |
|---|---|
| ***C11D 7/50*** | (2006.01) |
| ***C11D 11/00*** | (2006.01) |
| ***C11D 7/24*** | (2006.01) |
| ***C11D 7/26*** | (2006.01) |

(52) U.S. Cl.
CPC ..... *C11D 11/0017* (2013.01); *C11D 7/242* (2013.01); *C11D 7/263* (2013.01); *C11D 7/5018* (2013.01); *C11D 7/5022* (2013.01)

(58) Field of Classification Search
CPC ..... C11D 7/50; C11D 7/5018; C11D 7/5068; C11D 11/0017; C11D 3/2006; C11D 3/201; C11D 3/20141; C11D 7/5022
See application file for complete search history.

(56) References Cited

U.S. PATENT DOCUMENTS

| | | | | |
|---|---|---|---|---|
| 6,159,917 | A | 12/2000 | Baran, Jr. et al. | |
| 6,846,790 | B2 | 1/2005 | Evers et al. | |
| 7,320,954 | B2 | 1/2008 | Kaneko | |
| 2003/0228997 | A1* | 12/2003 | Doyel | C11D 7/509 510/410 |
| 2005/0132508 | A1 | 6/2005 | Overdevest | |
| 2006/0200914 | A1* | 9/2006 | Evers | D06L 1/02 8/142 |

FOREIGN PATENT DOCUMENTS

| | | |
|---|---|---|
| EP | 2684945 | 1/2014 |
| JP | 11-310789 | 11/1999 |
| KR | 10-2005-0005415 | 1/2008 |
| WO | WO 00-36206 | 6/2000 |
| WO | WO 03-038178 | 5/2003 |

OTHER PUBLICATIONS

European Search Report dated Aug. 28, 2020 issued in Application No. 18735961.7.
International Search Report dated May 21, 2018 issued in Application No. PCT/KR2018/000384.

* cited by examiner

*Primary Examiner* — Charles I Boyer
(74) *Attorney, Agent, or Firm* — KED & Associates LLP

(57) ABSTRACT

A detergent composition for dry cleaning is disclosed. The detergent composition for dry cleaning includes a) 5 to 10% by weight of a fluorinated (fluoro-based) solvent, b) 1 to 2% by weight of a cleaning booster, c) 5 to 10% by weight of an anti-shrinkage agent, d) 40 to 50% by weight of a water-soluble solvent, and e) 30 to 40% by weight of water.

2 Claims, No Drawings

DETERGENT COMPOSITION CONTAINING A FLUORINATED SOLVENT FOR DRY CLEANING

CROSS-REFERENCE TO RELATED PATENT APPLICATIONS

This application is a U.S. National Stage Application under 35 U.S.C. § 371 of PCT Application No. PCT/KR2018/000384, filed Jan. 9, 2018, which claims priority to Korean Patent Application No. 10-2017-0003000, filed Jan. 9, 2017, whose entire disclosures are hereby incorporated by reference.

TECHNICAL FIELD

The present invention relates to a detergent composition for dry cleaning, and more particularly to a detergent composition for dry cleaning to implement dry cleaning.

BACKGROUND ART

Dry cleaning, which is also called "dry washing", is a cleaning (washing) method using an organic solvent instead of water and is thus widely used for wool or silk products wherein the shape and dye of fabrics are easily damaged.

In accordance with the dry cleaning method, in the case of fabrics (for example, natural protein fabrics such as wool or silk fabrics and artificial silk or acetate fabrics) wherein the gloss of fabrics is lost due to deformation on the surface and the inside of fabrics, or undergo deformation, such as shrinkage or extension because of alkali washing conditions, long-term contact with water, and the physical force of a washing machine strongly driven for a long period of time, oily contaminants are removed by dissolution in petroleum, chlorine, glycol ester, cyclic silicone or silicone, fluorine and terpene oil-based solvents such as limonene, and these solvents are removed from the clothes by physical methods, followed by drying to volatilize the solvent.

Perchloroethylene (PERC), trichlorethylene and the like, which are chlorine-based solvents most commonly used for dry cleaning, have advantages of not causing damage to fabrics and being nonflammable. However, these solvents have problems of causing air pollution, being non-biodegradable and being carcinogenic particularly to humans.

Recently, as C5-C13 petroleum-based solvents, hydrocarbons including a combination of linear, branched and cyclic hydrocarbons or the like, have been used, instead of chlorinated solvents. However, these hydrocarbon solvents have risks of fire and explosion, and problems of causing environmental pollution (VOC causing formation of ozone) and microbial contamination in the solvent. Another typical hydrocarbon-based dry cleaning solvent, Stoddard solvent, has been found to have inhalation carcinogenicity.

In order to solve the problems described above, Korean Patent No. KR10-1128856 discloses a solvent represented by the following formula.

[Formula]

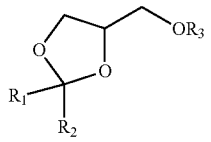

However, when the compound represented by the above formula is subjected to hot-air drying, strong acetone smell may be emitted due to decomposition of the compound. When the water is used in an amount of 20% or less, there are problems in that the wrinkle performance is not improved in the clothes for dry cleaning and removal of aqueous contaminants is difficult. In addition, this may affect plastic stability, thus causing problems including peeling off of coatings or deterioration in gloss.

DISCLOSURE

Technical Problem

Therefore, the present invention has been made in view of the above problems, and it is one object of the present invention to provide a (detergent) composition for dry cleaning that exhibits excellent affinity to water and has an excellent effect of removing oily and aqueous contaminants.

It is another object of the present invention to provide a (detergent) composition for dry cleaning that has excellent polymer stability and thus allows dry cleaning in a non-closed-type styler.

The object of the present invention is not limited to those described above and other objects not described herein will be clearly understood by those skilled in the art from the following description.

Technical Solution

In accordance with the present invention, the above and other objects can be accomplished by the provision of a detergent composition for dry cleaning including a) 5 to 10% by weight of a fluorinated (fluoro-based) solvent, b) 1 to 2% by weight of a cleaning booster, c) 5 to 10% by weight of an anti-shrinkage agent, d) 40 to 50% by weight of a water-soluble solvent, and e) 30 to 40% by weight of water. The a) fluorinated solvent may include at least one selected from the group consisting of fluorine-based solvents represented by the following Formula 1 and may be used alone or in combination. The fluorine-based solvent has excellent solubilization ability to accommodate water due to the amphipathicity thereof and thus is easily used in combination with water and a surfactant. In addition, the fluorinated solvent is used in an amount of 10% by weight or less in order to ensure stability.

$$R—(CH_2)_m(CH_2)_n—R \quad \text{[Formula 1]}$$

Wherein m is an integer of 0 to 4, n is an integer of 1 to 5, and R is H or F, or CH3, CH3O or CF3.

In accordance with another aspect of the present invention, there is provided a composition effective for maximizing the cleaning power and maintaining the shape of laundry after washing by using a cleaning booster, an anti-shrinkage agent, a softening agent and an anti-wrinkle agent.

The details of other embodiments are incorporated in the detailed description and drawings.

Advantageous Effects

The detergent composition for dry cleaning according to the present invention contains water, a fluorinated solvent, a water-soluble solvent, a cleaning booster and an anti-shrinkage agent as active (effective) ingredients, thus simultaneously exhibiting excellent effects for removing oily and aqueous contaminants, being safe to humans and the environment and being non-inflammable.

Also, the detergent composition according to the present invention is a product using a fluorinated solvent having excellent polymer safety, is suitable for use as a laundry detergent because it enables easy drying under ordinary washing conditions and is very suitable as a laundry detergent in terms of various physical properties.

The effects of the present invention are not limited to those described above and other effects not described herein will be clearly understood by those skilled in the art from the description in the claims.

BEST MODE

Hereinafter, preferred embodiments of the present invention and physical properties of respective components will be described in detail and this detailed description is provided only in order for those skilled in the art to easily implement the present invention and should not be construed as limiting the scope and technical concept of the present invention.

The detergent composition for dry cleaning according to the present invention includes: a) 5 to 10% by weight of a fluorinated (fluoro-based) solvent; b) 1 to 2% by weight of a cleaning booster; c) 5 to 10% by weight of an anti-shrinkage agent; d) 40 to 50% by weight of a water-soluble solvent; and e) 30 to 40% by weight of water.

The ingredients of the composition will be described in detail as follows.

a) Fluorinated (Fluoro-Based) Solvent

The fluorinated solvent according to the present embodiment has excellent cleaning ability against oily contaminants and is relatively excellent in affinity with water in the composition, so that it can be used in combination with water. The fluorinated solvent of the present invention is excellent in solubilizing ability to accommodate water due to excellent amphiphilicity, so that it can be easily used in combination with water and a surfactant.

When used alone, the fluorinated solvent can provide optimal effects in terms of drying speed, cleaning performance and plastic stability. However, since the fluorinated solvents is non-miscible with water conducting other functions, the phase may become turbid or layer separation may occur when used in an amount exceeding 10%, and thus the effects described above cannot be obtained. Also, when the fluorinated solvent is used in an amount of less than 5%, the cleaning rate cannot exhibit adequate cleaning performance. Thus, the use of 5 to 10% by weight of the detergent composition for dry cleaning according to the present embodiment can achieve an optimum effect in terms of drying speed, cleaning performance and plastic stability.

The fluorinated solvent according to the present embodiment may be at least one selected from the group represented by the following Formula 1, or a combination thereof.

$$R—(CH_2)_m(CF_2)_n—R \quad \text{[Formula 1]}$$

Wherein m is an integer of 0 to 4, n is an integer of 1 to 5, and R is H or F, or CH3, CH3O or CF3. The fluorinated solvent according to the present embodiment may be selected from the group consisting of perfluoroheptane (PFH), pentafluorobutane (PFB), decafluoropentane (DFP), methoxy nonafluorobutane (MNF) or a mixture thereof.

b) Cleaning Booster

The detergent composition for dry cleaning of the present embodiment includes a cleaning booster which may be selected from the group consisting of a compound represented by the following Formula 2, a compound represented by the following Formula 3 and a compound represented by the following Formula 4:

$$C_6H_5—CH_2O—(CH_2CH_2O)_m—R_1 \quad \text{[Formula 2]}$$

$$R_2—O—(CH_2CH_2O)_m—R_1 \quad \text{[Formula 3]}$$

$$R_1—R_3—R_2 \quad \text{[Formula 4]}$$

Wherein m is an integer of 1 to 5, R1 is H or alkyl having 1 to 4 carbon atoms, R2 is alkyl having 1 to 8 carbon atoms, and R3 is alkyl or alkene having 3 to 20 carbon atoms. The cleaning booster according to the present embodiment may be isoalkane (C10-C13 isoalkanes, IP), propylene glycol monomethyl ether (PM), or a mixture thereof.

When the cleaning booster is used in combination with a fluorinated solvent, in particular, in an amount of less than 1%, the cleaning performance may be significantly lowered. In addition, when the cleaning booster is used in an amount of higher than 2%, problems associated with plastic stability may occur. Thus, the plastic may crack or break upon use for a long time.

c) Anti-Shrinkage Agent

The detergent composition for dry cleaning according to the present embodiment includes an anti-shrinkage agent. The anti-shrinkage agent according to the present embodiment may include at least one selected from the group consisting of propylene glycol (PG), hexylene glycol (HG), ethylene glycol (EG), butylene glycol (BG), 3-methoxy-3-methyl-1-butanol (3-MMB) and a combination thereof.

In the case where the anti-shrinkage agent is used in combination with a fluorinated solvent, when it is used in an amount of less than 5%, the clothes may shrink and, when it is used in an amount of higher than 10%, the drying speed of the clothes may be reduced and efficiency may be deteriorated.

d) Water-Soluble Solvent

The detergent composition for dry cleaning according to the present embodiment includes a water-soluble solvent. By using the water-soluble solvent, the viscosity can be maintained over a long period of time, the availability (usability) is not deteriorated and the deodorizing effect is further maintained.

The water-soluble solvent is a medicinal agent that is miscible with water and may include at least one selected from the group consisting of ethanol (EtOH), n-propanol (NPA), iso-propanol (IPA), n-butanol (NBA), n-pentanol (NPA), n-hexanol (NHA) and a combination thereof.

When the water-soluble solvent is used in an amount less than 40%, the fluorinated solvent is not mixed with water and the cleaning performance using the fluorinated solvent according to the present embodiment cannot be obtained. Further, when the water-soluble solvent is used in an amount exceeding 50%, there is the risk of flammability and washing performance may be lowered.

Examples and Comparative Examples

Hereinafter, the present embodiment will be described in detail with reference to the following Examples and Comparative Examples. However, these examples are provided only for illustration and should not be construed as limiting the scope of the present invention.

Each dry cleaning agent was prepared in accordance with the compositions shown in Tables 1 and 2 below. At this time, the dry cleaning agent was prepared by adding a fluorinated solvent, a water-soluble solvent, a cleaning booster and an anti-shrinkage agent to water and stirring at room temperature until a clear liquid state was obtained.

TABLE 1

| Ingredient | | Example 1 | Example 2 | Example 3 | Example 4 | Example 5 | Example 6 | Example 7 | Example 8 | Example 9 | Example 10 | Example 11 | Example 12 |
|---|---|---|---|---|---|---|---|---|---|---|---|---|---|
| Fluoro solvent | PFH | 10 | | | | 5 | 5 | 5 | | | | 3 | |
| | PFB | | 10 | | | 5 | | | 5 | 5 | | | 3 |
| | DEP | | | 10 | | | 5 | | 5 | | 5 | 3 | 5 |
| | MNF | | | | 10 | | | 5 | | 5 | 5 | | |
| Cleaning booster | IP | 1 | 1 | 1 | 1 | 1 | 1 | 0.5 | 0.5 | 0.5 | 0.5 | 0.5 | 0.5 |
| | PM | 0.5 | 0.5 | 0.5 | 0.5 | 0.5 | 0.5 | 1 | 1 | 1 | 1 | 1 | 1 |
| 3-MMB(Anti-shrinkage agent) | | 8.5 | 8.5 | 8.5 | 8.5 | 8.5 | 8.5 | 8.5 | 8.5 | 8.5 | 8.5 | 8.5 | 8.5 |
| Water-soluble solvent | NPA | — | — | — | — | — | — | 45 | 45 | 45 | 45 | 45 | 45 |
| | IPA | 45 | 45 | 43 | 43 | 43 | 43 | — | — | — | — | — | — |
| Water | | Balance | Balance | Balance | Balance | Balance | Balance | Balance | Balance | Balance | Balance | Balance | Balance |

TABLE 2

| Ingredient | | Comparative Example 1 | Comparative Example 2 | Comparative Example 3 | Comparative Example 4 | Comparative Example 5 | Comparative Example 6 |
|---|---|---|---|---|---|---|---|
| Fluoro solvent | PFH | 3 | | 15 | | 10 | |
| | PFB | | | | | | |
| | DEP | | 3 | | 15 | | 15 |
| | MNF | | | | | | |
| Cleaning booster | IP | 1 | 0.5 | 1 | 1 | 0.5 | 1 |
| | PM | 0.5 | 1 | 0.5 | 0.5 | — | 0.5 |
| 3-MMB(Anti-shrinkage agent) | | 8.5 | 8.5 | 8.5 | 8.5 | 8.5 | 8.5 |
| Water-soluble solvent | NPA | 45 | — | — | 45 | — | — |
| | IPA | — | 45 | 45 | — | 45 | 60 |
| Water | | Balance | Balance | Balance | Balance | Balance | Balance |

The phase stability, polymer stability, flammability and cleaning rate of the detergent compositions of Examples 1 to 12 and Comparative Examples 1 to 6 were evaluated, and the results are shown in Table 3.

TABLE 3

| Items | Phase stability (50° C.) | Phase stability (−15° C.) | Polymer stability HDPE | LDPE | PP | ABS | PC | Flammability | Cleaning rate (%) |
|---|---|---|---|---|---|---|---|---|---|
| Example 1 | Good | Good | ◎ | ◎ | ◎ | ◎ | ◎ | nonflammable | >95 |
| Example 2 | Good | Good | ◎ | ◎ | ◎ | ◎ | ◎ | nonflammable | >95 |
| Example 3 | Good | Good | ◎ | ◎ | ◎ | ◎ | ◎ | nonflammable | >95 |
| Example 4 | Good | Good | ◎ | ◎ | ◎ | ◎ | ◎ | nonflammable | >95 |
| Example 5 | Good | Good | ◎ | ◎ | ◎ | ◎ | ◎ | nonflammable | >95 |
| Example 6 | Good | Good | ◎ | ◎ | ◎ | ◎ | ◎ | nonflammable | >95 |
| Example 7 | Good | Good | ◎ | ◎ | ◎ | ◎ | ◎ | nonflammable | >95 |
| Example 8 | Good | Good | ◎ | ◎ | ◎ | ◎ | ◎ | nonflammable | >95 |
| Example 9 | Good | Good | ◎ | ◎ | ◎ | ◎ | ◎ | nonflammable | >95 |
| Example 10 | Good | Good | ◎ | ◎ | ◎ | ◎ | ◎ | nonflammable | >95 |
| Example 11 | Good | Good | ◎ | ◎ | ◎ | ◎ | ◎ | nonflammable | >95 |
| Example 12 | Good | Good | ◎ | ◎ | ◎ | ◎ | ◎ | nonflammable | >95 |
| Example 13 | Good | Good | ◎ | ◎ | ◎ | ◎ | ◎ | nonflammable | >95 |
| Example 14 | Good | Good | ◎ | ◎ | ◎ | ◎ | ◎ | nonflammable | >95 |
| Example 15 | Good | Good | ◎ | ◎ | ◎ | ◎ | ◎ | nonflammable | >95 |
| Example 16 | Good | Good | ◎ | ◎ | ◎ | ◎ | ◎ | nonflammable | >95 |
| Comparative Example 1 | Good | Good | ◎ | ◎ | ◎ | ◎ | ◎ | nonflammable | <50 |
| Comparative Example 2 | Good | Good | ◎ | ◎ | ◎ | ◎ | ◎ | nonflammable | <60 |
| Comparative Example 3 | Poor | Poor | ◎ | ◎ | ◎ | X | Δ | nonflammable | — |
| Comparative Example 4 | Poor | Poor | ◎ | ◎ | ◎ | Δ | ○ | nonflammable | — |
| Comparative Example 5 | Good | Good | ◎ | ◎ | ◎ | ◎ | ◎ | nonflammable | <60 |
| Comparative Example 6 | Good | Good | ◎ | ◎ | ◎ | ◎ | ◎ | flammable | <60 |

The phase stability in Table 3 was evaluated by visually observing phase separation of the detergent stock solution after allowing the detergent stock solution to stand in an oven at 50° C. for one week. After one week, when the phase of the detergent stock solution is suspended and separated, it is recorded as "defective", or when the phase of the detergent solution is normal, it is recorded as "good".

The polymer stability in Table 3 was evaluated by allowing various types of polymers, specifically, high-density polyethylene (HDPE), low-density polyethylene (LDPE), polypropylene (PP), acrylonitrile-butadiene-styrene (ABS) and polycarbonate (PC) to stand in respective detergent compositions for 3 weeks, and then measuring the change of the polymer surface and the change of the weight of the polymer. At this time, the change of the surface state of the polymer such as cracks on the polymer surface and the weight change by elution of the polymer component may occur. In this case, evaluation was conducted depending on the deformation degree of polymers, as shown in Table 4.

TABLE 4

| | |
|---|---|
| Polymer stability | ◎: No polymer surface change, no weight reduction, very good<br>○: No polymer surface change, weight variation of 5% or less, good<br>Δ: No polymer surface change, weight variation of 20% or less, slight poor<br>Δ: Polymer cracks, poor |

The cleaning rate in Table 3 is measured using a colorimeter compared to the case of washing using a washing machine, and the symbol "<" means indication by a maximum measured value.

As can be seen from the above results, when the fluorinated solvent is used in an amount of 5 to 10% by weight, the same effect can be obtained, despite using, as the fluorine solvent, perfluoroheptane (PFH), pentafluorobutane (PFB), decafluoropentane (DFP), methoxy nonafluorobutane (MNF) or a combination thereof.

In the case of the cleaning booster as well, the same effect can be obtained, despite using isoalkane (C10-C13 isoalkanes, IP) and propylene glycol monomethyl ether (PM), in a certain amount varied within 1 to 2% by weight.

In the case of the water-soluble solvent, the same effect can be obtained despite using propanol (NPA) and isopropanol (IPA) in the range of 40 to 50% by weight.

As can be seen from Examples 1 to 16 of Table 1, the detergent composition for dry cleaning of the present invention, which is prepared by adding water, a fluorinated solvent, a water-soluble solvent, a cleaning booster and an anti-shrinkage agent, can effectively remove oily and aqueous contaminants on the fabric surface and secure stability and (safety) to various kinds of polymers.

As can be seen from Comparative Examples that do not fall within the range of values according to the present embodiment, as in Comparative Examples 1 and 2, when the fluorine-based solvent is used in an amount of less than 5% by weight, the cleaning rate was significantly low, compared to Examples, and as in Comparative Examples 3 and 4, when the fluorine-based solvent is used in an amount of higher than 10% by weight, there are problems of poor phase stability or polymer stability, compared to Examples.

In addition, as in Comparative Example 5, when the cleaning booster is used in an amount of less than 1% by weight, the cleaning rate is considerably low, compared to Examples and as in Comparative Example 6, when the water-soluble solvent is used in an amount of higher than 50% by weight, there are problems of low cleaning rate and inflammability.

The invention claimed is:

1. A detergent composition for dry cleaning comprising:

a) 5 to 10% by weight of a fluorinated (fluoro-based) solvent;

b) 1 to 2% by weight of a cleaning booster;

c) 5 to 10% by weight of an anti-shrinkage agent;

d) 40 to 50% by weight of a water-soluble solvent; and e) 30 to 40% by weight of water, wherein the a) fluorinated solvent comprises at least one selected from the group consisting of the following Formula 1 and a combination thereof:

$$R—(CH_2)_m(CF_2)_n—R \quad \text{[Formula 1]}$$

where m is an integer of 0 to 4, n is an integer of 1 to 5, and R is H or F, or $CH_3$, $CH_3O$ or $CF_3$, wherein the b) cleaning booster comprises at least one selected from the group consisting of a compound represented by the following Formula 2, a compound represented by the following Formula 3 and a compound represented by the following Formula 4:

$$C_6H_5—CH_2O—(CH_2CH_2O)_m—R_1 \quad \text{[Formula 2]}$$

$$R_2—O—(CH_2CH_2O)_m—R_1 \quad \text{[Formula 3]}$$

$$R_1—R_3—R_2 \quad \text{[Formula 4]}$$

where m is an integer of 1 to 5, $R_1$ is H or alkyl having 1 to 4 carbon atoms, $R_2$ is alkyl having 1 to 8 carbon atoms, and $R_3$ is alkyl or alkene group having 3 to 20 carbon atoms, and wherein the d) water-soluble solvent comprises at least one selected from the group consisting of ethanol (EtOH), n-propanol (NPA), isopropanol (IPA), n-butanol (NBA), n-pentanol (NPA), n-hexanol (NHA) and a combination thereof.

2. The detergent composition for dry cleaning according to claim 1, wherein the c) anti-shrinkage agent comprises at least one selected from the group consisting of propylene glycol (PG), hexylene glycol (HG), ethylene glycol (EG), butylene glycol (BG), 3-methoxy-3-methyl-1-butanol (3-MMB) and a combination thereof.

* * * * *